US012523224B2

(12) United States Patent
Sato et al.

(10) Patent No.: US 12,523,224 B2
(45) Date of Patent: Jan. 13, 2026

(54) SCROLL COMPRESSOR

(71) Applicant: KABUSHIKI KAISHA TOYOTA JIDOSHOKKI, Aichi-ken (JP)

(72) Inventors: Yoshihiko Sato, Kariya (JP); Yoshihiro Fukaya, Kariya (JP); Yuya Hattori, Kariya (JP); Kai Inatsu, Kariya (JP)

(73) Assignee: KABUSHIKI KAISHA TOYOTA JIDOSHOKKI, Aichi-Ken (JP)

( * ) Notice: Subject to any disclaimer, the term of this patent is extended or adjusted under 35 U.S.C. 154(b) by 0 days.

(21) Appl. No.: 19/068,638

(22) Filed: Mar. 3, 2025

(65) Prior Publication Data

US 2025/0305501 A1 Oct. 2, 2025

(30) Foreign Application Priority Data

Mar. 27, 2024 (JP) ..... 2024-051987

(51) Int. Cl.
*F04C 29/00* (2006.01)
*F04C 18/02* (2006.01)

(52) U.S. Cl.
CPC ..... *F04C 29/0057* (2013.01); *F04C 18/0215* (2013.01)

(58) Field of Classification Search
CPC ..... F04C 18/0215; F04C 29/0057
See application file for complete search history.

(56) References Cited

U.S. PATENT DOCUMENTS

| | | | | |
|---|---|---|---|---|
| 12,049,896 | B2 * | 7/2024 | Busch | F04C 18/0215 |
| 2018/0187679 | A1 * | 7/2018 | Nomura | F04C 29/028 |
| 2019/0301464 | A1 * | 10/2019 | Kuma | F04C 29/0021 |
| 2023/0323880 | A1 * | 10/2023 | Busch | F04C 29/0021 418/55.1 |
| 2024/0026881 | A1 | 1/2024 | Teshima et al. | |
| 2025/0320869 | A1 * | 10/2025 | Haseley | F04C 18/0215 |

FOREIGN PATENT DOCUMENTS

| | | |
|---|---|---|
| JP | 2022-098559 A | 7/2022 |
| JP | 2023-160313 A | 11/2023 |

* cited by examiner

*Primary Examiner* — Anthony Ayala Delgado
(74) *Attorney, Agent, or Firm* — Greenblum & Bernstein, P.L.C.

(57) ABSTRACT

A scroll compressor includes a rotary shaft, an eccentric shaft that is eccentric with respect to an axis of the rotary shaft, a bushing that receives the eccentric shaft, and a shaft balancer that rotates integrally with the rotary shaft. The bushing includes a bushing balancer. The shaft balancer includes a first section and a second section. When viewed in the axial direction of the rotary shaft, the first section is located on the same side of a second straight line as the center of gravity of the bushing balancer. The second straight line contains the center of gravity of the shaft balancer and the axis of the rotary shaft. The second section is located on an opposite side of the second straight line from the center of gravity of the bushing balancer. The stiffness of the first section is lower than the stiffness of the second section.

4 Claims, 7 Drawing Sheets

SCROLL COMPRESSOR

CROSS-REFERENCE TO RELATED APPLICATIONS

This application is based upon and claims the benefit of priority from Japanese Patent Application No. 2024-051987, filed on Mar. 27, 2024, the entire contents of which are incorporated herein by reference.

BACKGROUND

1. Field

The present disclosure relates to a scroll compressor.

2. Description of Related Art

For example, as disclosed in Japanese Laid-Open Patent Publication No. 2023-160313, a scroll compressor includes a rotary shaft, an eccentric shaft, a fixed scroll, an orbiting scroll, and a bushing. The eccentric shaft projects from the distal end of the rotary shaft. The eccentric shaft extends parallel to the rotary shaft at a position offset from the axis of the rotary shaft. The fixed scroll includes a fixed base plate and a fixed volute wall. The fixed volute wall extends from the fixed base plate. The orbiting scroll includes an orbiting base plate and an orbiting volute wall. The orbiting base plate is opposed to the fixed base plate. The orbiting volute wall extends toward the fixed base plate from the orbiting base plate. The orbiting volute wall is meshed with the fixed volute wall.

The bushing includes a cylindrical portion inserted into the orbiting base plate so as to be rotatable with respect to the orbiting base plate. The cylindrical portion includes an insertion hole. The insertion hole receives the eccentric shaft. The axis of the eccentric shaft is disposed at a position offset from a first straight line that contains the axis of the cylindrical portion and the axis of the rotary shaft when viewed in the axial direction of the rotary shaft. The bushing is configured to be swingable about the eccentric shaft. In such a scroll compressor, the orbital radius of the orbiting scroll is changed by swinging motion of the bushing about the eccentric shaft. When the orbital radius of the orbiting scroll is changed, the orbiting volute wall is appropriately pressed against the fixed volute wall.

In a scroll compressor, as the rotary shaft rotates and the orbiting scroll performs orbital motion, centrifugal force acts on the orbiting scroll. This centrifugal force generates a moment about the eccentric shaft. This moment may cause the orbiting volute wall to be excessively pressed against the fixed volute wall. In order to counteract the above-mentioned centrifugal force and moment, scroll compressors equipped with a bushing balancer and a shaft balancer are known. The bushing balancer projects from the cylindrical portion of the bushing and outward in the radial direction of the cylindrical portion. The shaft balancer projects radially outward from the rotary shaft and rotates integrally with the rotary shaft.

In the scroll compressor described above, the rotation speed of the rotary shaft changes between a low rotation speed range and a high rotation speed range. When the rotation speed changes, the swing amount of the bushing balancer changes due to the influence of the centrifugal force acting on the bushing balancer. For example, in a case in which the scroll compressor is designed such that the moment generated by the bushing balancer and the moment generated by the orbiting scroll are balanced when the rotary shaft rotates in a medium rotation speed range, the following problem occurs. When the rotary shaft rotates in a high rotation speed range, the centrifugal force acting on the bushing balancer increases, and thus the swing amount of the bushing balancer increases. Consequently, the center of gravity of the bushing balancer shifts in the swing direction of the bushing balancer, resulting in an imbalance between the moment generated by the bushing balancer and the moment generated by the orbiting scroll. This imbalance makes the rotary shaft more prone to vibration.

SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

In one general aspect, a scroll compressor includes a rotary shaft, an eccentric shaft, a fixed scroll, an orbiting scroll, a bushing, and a shaft balancer. The eccentric shaft projects from a distal end of the rotary shaft and extends parallel to the rotary shaft at a position offset from an axis of the rotary shaft. The fixed scroll includes a fixed base plate and a fixed volute wall extending from the fixed base plate. The orbiting scroll includes an orbiting base plate and an orbiting volute wall. The orbiting base plate faces the fixed base plate. The orbiting volute wall extends from the orbiting base plate toward the fixed base plate and meshing with the fixed volute wall. The bushing includes an insertion hole that receives the eccentric shaft. The bushing is configured to swing about the eccentric shaft. The shaft balancer projects from the rotary shaft and outward in a radial direction of the rotary shaft. The shaft balancer is configured to rotate integrally with the rotary shaft. The bushing includes a cylindrical portion that includes the insertion hole and is inserted into the orbiting base plate so as to be rotatable with respect to the orbiting base plate, and a bushing balancer that projects from the cylindrical portion and outward in a radial direction of the cylindrical portion. When viewed in an axial direction of the rotary shaft, a center of gravity of the bushing balancer is located on a same side of a first straight line as an axis of the eccentric shaft. The first straight line contains an axis of the cylindrical portion and the axis of the rotary shaft. When viewed in the axial direction of the rotary shaft, a center of gravity of the shaft balancer is located on an opposite side of a straight line from the eccentric shaft. The straight line contains the axis of the rotary shaft and being orthogonal to the first straight line. When viewed in the axial direction of the rotary shaft, a direction of a moment about the eccentric shaft generated by a centrifugal force acting on the bushing balancer is a direction away from the center of gravity of the shaft balancer. The shaft balancer includes a first section and a second section. The first section is located, when viewed in the axial direction of the rotary shaft, on a same side of a second straight line as the center of gravity of the bushing balancer. The second straight line contains the center of gravity of the shaft balancer and the axis of the rotary shaft. The second section is located on an opposite side of the second straight line from the center of gravity of the bushing balancer. A stiffness of the first section is lower than a stiffness of the second section.

Other features and aspects will be apparent from the following detailed description, the drawings, and the claims.

BRIEF DESCRIPTION OF THE DRAWINGS

Throughout the drawings and the detailed description, the same reference numerals refer to the same elements. The drawings may not be to scale, and the relative size, proportions, and depiction of elements in the drawings may be exaggerated for clarity, illustration, and convenience.

DETAILED DESCRIPTION

This description provides a comprehensive understanding of the methods, apparatuses, and/or systems described. Modifications and equivalents of the methods, apparatuses, and/or systems described are apparent to one of ordinary skill in the art. Sequences of operations are exemplary, and may be changed as apparent to one of ordinary skill in the art, with the exception of operations necessarily occurring in a certain order. Descriptions of functions and constructions that are well known to one of ordinary skill in the art may be omitted.

Exemplary embodiments may have different forms, and are not limited to the examples described. However, the examples described are thorough and complete, and convey the full scope of the disclosure to one of ordinary skill in the art.

In this specification, "at least one of A and B" should be understood to mean "only A, only B, or both A and B."

First Embodiment

A scroll compressor 10 according to a first embodiment will now be described with reference to FIGS. 1 to 4. The scroll compressor 10, which will be discussed below, is used, for example, in a vehicle air conditioner.

Overview of Scroll Compressor

Figure 1:
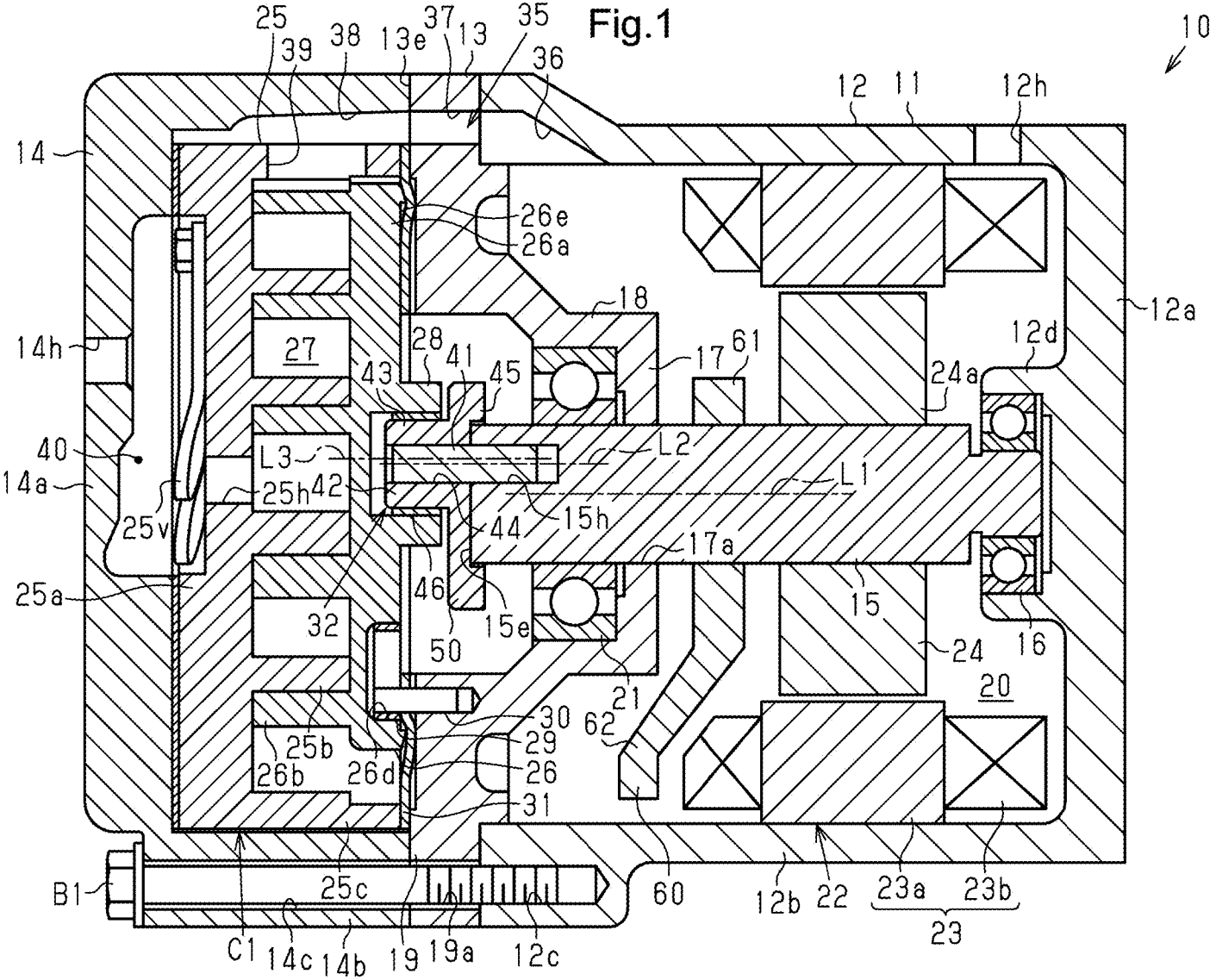
FIG. 1 is a cross-sectional view of a scroll compressor according to a first embodiment.

As shown in FIG. 1, the scroll compressor 10 includes a tubular housing unit 11. The housing unit 11 includes a motor housing 12, a shaft support housing 13, and a discharge housing 14. The motor housing 12, the shaft support housing 13, and the discharge housing 14 are made of metal. The motor housing 12, the shaft support housing 13, and the discharge housing 14 are made of, for example, aluminum. The scroll compressor 10 includes a rotary shaft 15. The rotary shaft 15 is accommodated in the housing unit 11.

The motor housing 12 includes a plate-shaped end wall 12*a* and a tubular peripheral wall 12*b*. The peripheral wall 12*b* extends from the outer periphery of the end wall 12*a*. The axial direction of the peripheral wall 12*b* agrees with the axial direction of the rotary shaft 15. The motor housing 12 includes internal thread holes 12*c*. The internal thread holes 12*c* are formed in an open end of the peripheral wall 12*b*. For illustrative purposes, only one of the internal thread hole 12*c* is illustrated in FIG. 1. The motor housing 12 includes an inlet 12*h*. The inlet 12*h* draws in a refrigerant, which is a fluid. The inlet 12*h* is formed in a portion of the peripheral wall 12*b* that is close to the end wall 12*a*. The inlet 12*h* communicates between the inside and the outside of the motor housing 12.

The motor housing 12 includes a cylindrical bearing holding portion 12*d*. The bearing holding portion 12*d* projects from a central portion of the inner surface of the end wall 12*a*. A first end, which is one end of the rotary shaft 15 in the axial direction, is inserted into the bearing holding portion 12*d*. The scroll compressor 10 includes a bearing 16. The bearing 16 is, for example, a rolling-element bearing. The bearing 16 is disposed between the inner circumferential surface of the bearing holding portion 12*d* and the outer circumferential surface of the first end of the rotary shaft 15. The first end of the rotary shaft 15 is rotatably supported by the motor housing 12 via the bearing 16.

The shaft support housing 13 includes a plate-shaped end wall 17 and a tubular peripheral wall 18. The peripheral wall 18 extends from the outer periphery of the end wall 17. The axial direction of the peripheral wall 18 agrees with the axial direction of the rotary shaft 15. The shaft support housing 13 includes an annular flange wall 19. The flange wall 19 extends outward in the radial direction of the rotary shaft 15 from an end of the of the peripheral wall 18 on the side opposite from the end wall 17.

The shaft support housing 13 includes a circular insertion hole 17*a*. The insertion hole 17*a* is formed at the center of the end wall 17. The insertion hole 17*a* extends through the end wall 17 in the thickness direction. The rotary shaft 15 extends through the insertion hole 17*a*.

The rotary shaft 15 has a distal end face 15*e* located at a second end, which is the other end in the axial direction. The distal end face 15*e* is located inside the peripheral wall 18. The rotary shaft 15 includes a press-fit hole 15*h* in the distal end face 15*e*. The press-fit hole 15*h* has a circular shape. The axis of the press-fit hole 15*h* extends parallel to an axis L1 of the rotary shaft 15 at a position offset from the axis L1 of the rotary shaft 15.

The scroll compressor 10 includes a bearing 21. The bearing 21 is, for example, a rolling-element bearing. The bearing 21 is disposed between the inner circumferential surface of the peripheral wall 18 and the outer circumferential surface of the rotary shaft 15. The rotary shaft 15 is rotatably supported by the shaft support housing 13 via the bearing 21. Thus, the shaft support housing 13 rotatably supports the rotary shaft 15. In this manner, the rotary shaft 15 is rotatably supported by the housing unit 11.

The shaft support housing 13 includes multiple bolt insertion holes 19*a*. Each bolt insertion hole 19*a* is formed in the outer peripheral portion of the flange wall 19. Each bolt insertion hole 19*a* extends through the flange wall 19 in the thickness direction. Each bolt insertion hole 19*a* of the flange wall 19 is continuous with the corresponding internal thread screw hole 12*c* of the motor housing 12. For illustrative purposes, only one of the bolt insertion holes 19*a* is shown in FIG. 1.

The scroll compressor 10 includes a motor chamber 20. The motor chamber 20 is defined by the motor housing 12 and the shaft support housing 13. The motor housing 12 defines the motor chamber 20 together with the shaft support housing 13. In this manner, the motor chamber 20 is formed in the housing unit 11. The motor chamber 20 is connected to the inlet 12*h*. Refrigerant is drawn into the motor chamber 20 through the inlet 12*h*.

The scroll compressor 10 includes a motor 22. The motor 22 is accommodated in the motor chamber 20. The motor 22 includes a tubular stator 23 and a tubular rotor 24. The rotor 24 is located on the radially inner side of the stator 23. The rotor 24 rotates integrally with the rotary shaft 15. The stator 23 surrounds the rotor 24. The rotor 24 includes a rotor core 24*a*, which is fixed to the rotary shaft 15, and permanent magnets (not shown), which are provided on the rotor core 24*a*.

The stator 23 includes a tubular stator core 23*a* and a motor coil 23*b*. The stator core 23*a* is fixed to the inner circumferential surface of the peripheral wall 12*b* of the motor housing 12. The motor coil 23*b* is wound around the stator core 23*a*. When power that is controlled by an inverter (not shown) is supplied to the motor coil 23*b*, the rotor 24 rotates. The rotary shaft 15 rotates integrally with the rotor 24. Therefore, the motor 22 rotates the rotary shaft 15.

The scroll compressor 10 includes a compression mechanism C1. The compression mechanism C1 includes a fixed scroll 25 and an orbiting scroll 26. The scroll compressor 10 thus includes the fixed scroll 25 and the orbiting scroll 26. The compression mechanism C1 is of a scroll type. As the rotary shaft 15 rotates, the orbiting scroll 26 orbits relative to the fixed scroll 25.

The fixed scroll 25 includes a fixed base plate 25*a* and a fixed volute wall 25*b*. The fixed base plate 25*a* has the shape of a disc. The fixed base plate 25*a* includes a discharge port 25*h* at the center. The discharge port 25*h* has a circular shape. The discharge port 25*h* extends through the fixed base plate 25*a* in the thickness direction. The fixed volute wall 25*b* extends from the fixed base plate 25*a*. The fixed scroll 25 includes an outer peripheral wall 25*c*. The outer peripheral wall 25*c* extends from the outer periphery of the fixed base plate 25*a*. The outer peripheral wall 25*c* surrounds the fixed volute wall 25*b*.

The scroll compressor 10 includes a valve mechanism 25*v*. The valve mechanism 25*v* is attached to a surface of the fixed base plate 25*a* that is on a side opposite to the fixed volute wall 25*b*. The valve mechanism 25*v* is configured to open and close the discharge port 25*h*.

The orbiting scroll 26 includes an orbiting base plate 26*a* and an orbiting volute wall 26*b*. The orbiting base plate 26*a* has the shape of a disc. The orbiting base plate 26*a* faces the fixed base plate 25*a*. The orbiting volute wall 26*b* extends from the orbiting base plate 26*a* toward the fixed base plate 25*a*. The orbiting volute wall 26*b* is meshed with the fixed volute wall 25*b*. The orbiting scroll 26 is located on the radially inner side of the outer peripheral wall 25*c*. The orbiting scroll 26 orbits on the radially inner side of the outer peripheral wall 25*c*. The distal end face of the fixed volute wall 25*b* is in contact with the orbiting base plate 26*a*. The distal end face of the orbiting volute wall 26*b* is in contact with the fixed base plate 25*a*.

The scroll compressor 10 includes compression chambers 27. The compression chambers 27 are defined by the fixed base plate 25*a*, the fixed volute wall 25*b*, the orbiting base plate 26*a*, and the orbiting volute wall 26*b*. Thus, the compression chambers 27 are defined between the fixed scroll 25 and the orbiting scroll 26. The compression chambers 27 take in refrigerant from the outside and compress the refrigerant.

The scroll compressor 10 includes a boss 28. The boss 28 is cylindrical. The orbiting base plate 26*a* includes an end face 26*e* on a side opposite to the fixed base plate 25*a*, and the boss 28 protrudes from the center of the end face 26*e*. The axial direction of the boss 28 agrees with the axial direction of the rotary shaft 15.

The orbiting base plate 26*a* includes groove portions 26*d*. The groove portions 26*d* are formed around the boss 28 in the end face 26*e* of the orbiting base plate 26*a*. The groove portions 26*d* are arranged at predetermined intervals in the circumferential direction of the rotary shaft 15. For illustrative purposes, only one of the groove portions 26*d* is illustrated in FIG. 1. A circular ring member 29 is fitted in each groove portion 26*d*. A pin 30 is inserted into each ring member 29. The pins 30 protrude from an end face 13*e* of the shaft support housing 13 that faces the orbiting scroll 26.

The scroll compressor 10 includes an elastic plate 31. The elastic plate 31 has an annular shape. The elastic plate 31 is held between the end face 13*e* of the shaft support housing 13 and the opening end face of the outer peripheral wall 25*c*. The elastic plate 31 constantly urges the orbiting scroll 26 toward the fixed scroll 25.

The discharge housing 14 includes a plate-shaped end wall 14*a* and a tubular peripheral wall 14*b*. The peripheral wall 14*b* extends from the outer periphery of the end wall 14*a*. The axial direction of the peripheral wall 14*b* agrees with the axial direction of the rotary shaft 15. The peripheral wall 14*b* surrounds the fixed scroll 25. Thus, the fixed scroll 25 is accommodated in the housing unit 11.

The discharge housing 14 includes multiple bolt insertion holes 14*c*. The bolt insertion holes 14*c* are formed in the peripheral wall 14*b*. For illustrative purposes, only one of the bolt insertion holes 14*c* is shown in FIG. 1. Each bolt insertion hole 14*c* is continuous with the corresponding bolt insertion hole 19*a* of the flange wall 19.

A bolt B1 is inserted into each bolt insertion hole 14*c* and the corresponding bolt insertion hole 19*a* of the flange wall 19, and is threaded into the corresponding internal thread hole 12*c* of the motor housing 12. This couples the shaft support housing 13 to the peripheral wall 12*b* of the motor housing 12, and couples the discharge housing 14 to the flange wall 19 of the shaft support housing 13. Accordingly, the motor housing 12, the shaft support housing 13, and the discharge housing 14 are arranged in that order in the axial direction of the rotary shaft 15. The fixed scroll 25 is held between the end wall 14*a* of the discharge housing 14 and the shaft support housing 13. The fixed scroll 25 is thus fixed to the housing unit 11.

The scroll compressor 10 includes a suction passage 35. The suction passage 35 includes a first groove 36, a first hole 37, a second groove 38, and a second hole 39. The first groove 36 is formed in a portion of the inner circumferential surface of the peripheral wall 12*b* of the motor housing 12. The first groove 36 opens in the opening end of the peripheral wall 12*b*. The first hole 37 is formed in the outer periphery of the flange wall 19 of the shaft support housing 13. The first hole 37 extends through the flange wall 19 in the thickness direction. The first hole 37 is connected to the first groove 36. The second groove 38 is formed in a portion of the inner circumferential surface of the peripheral wall 14*b* of the discharge housing 14. The second groove 38 is connected to the first hole 37. The second hole 39 is formed in the outer peripheral wall 25*c* of the fixed scroll 25. The second hole 39 extends through the outer peripheral wall 25*c* in the thickness direction. The second hole 39 is connected to the second groove 38. The second hole 39 is connected to the outermost part of each compression chamber 27.

The refrigerant gas in the motor chamber 20 is drawn into each compression chamber 27 through the first groove 36, the first hole 37, the second groove 38, and the second hole 39. The refrigerant gas drawn into the compression chamber 27 is compressed in the compression chamber 27 through the orbital motion of the orbiting scroll 26. In this manner, the compression mechanism C1 compresses the refrigerant drawn into the housing unit 11. The orbiting scroll 26 forms the compression chambers 27 together with the fixed scroll 25 through rotation of the rotary shaft 15.

The scroll compressor 10 includes a discharge chamber 40. The discharge chamber 40 is defined between the fixed base plate 25*a* and the end wall 14*a* of the discharge housing 14. The discharge chamber 40 is connected to the discharge port 25*h*. The refrigerant compressed in the compression chambers 27 is discharged to the discharge chamber 40. The discharge housing 14 includes an outlet 14*h*. The outlet 14*h* is formed in the end wall 14*a* of the discharge housing 14. The outlet 14*h* discharges the refrigerant discharged into the discharge chamber 40 to the outside of the housing unit 11.

Eccentric Shaft

The scroll compressor 10 includes an eccentric shaft 41. The eccentric shaft 41 is press-fitted into the press-fit hole 15*h* and projects from the distal end face 15*e* of the rotary shaft 15. The eccentric shaft 41 extends parallel to the rotary shaft 15 at a position offset from the axis L1 of the rotary shaft 15. The eccentric shaft 41 is a separate component from the rotary shaft 15. The axial direction of the eccentric shaft 41 agrees with the axial direction of the rotary shaft 15. The eccentric shaft 41 projects from the distal end face 15*e* of the rotary shaft 15 toward the orbiting scroll 26. The eccentric shaft 41 thus projects from the distal end of the rotary shaft 15. The eccentric shaft 41 is inserted into the boss 28.

Bushing

The scroll compressor 10 includes a bushing 42. The bushing 42 includes a cylindrical portion 43 inserted into the orbiting base plate 26*a* so as to be rotatable with respect to the orbiting base plate 26*a*. The cylindrical portion 43 includes an insertion hole 44. The bushing 42 thus includes the insertion hole 44. The insertion hole 44 extends through the cylindrical portion 43 in the axial direction of the cylindrical portion 43. The eccentric shaft 41 is inserted into the insertion hole 44. The eccentric shaft 41 is inserted into the insertion hole 44 in a state in which the axis L2 of the eccentric shaft 41 agrees with the axis of the insertion hole 44. The bushing 42 is swingable about the eccentric shaft 41. Most of the cylindrical portion 43 is disposed inside the boss 28. A base end of the cylindrical portion 43 projects from the boss 28.

The bushing 42 includes a swing restricting portion 45. The swing restricting portion 45 projects from a part of the outer circumferential surface of the portion of the cylindrical portion 43 projecting from the boss 28. The swing restricting portion 45 is disposed on the radially outer side of the rotary shaft 15. The swing restricting portion 45 is configured to come into contact with the outer circumferential surface of the rotary shaft 15 when the bushing 42 swings about the eccentric shaft 41. The swing restricting portion 45 restricts the swing of the bushing 42 beyond a prescribed range by contacting the rotary shaft 15.

The scroll compressor 10 includes a bearing 46. The bearing 46 is, for example, a cylindrical plain bearing. The bearing 46 is disposed inside the boss 28. The bearing 46 is disposed between the inner circumferential surface of the boss 28 and the outer circumferential surface of the cylindrical portion 43 of the bushing 42. The bushing 42 is rotatably supported by the boss 28 via the bearing 46.

Rotation of the rotary shaft 15 is transmitted to the orbiting scroll 26 via the eccentric shaft 41, the bushing 42, and the bearing 46. As a result, a force acts on the orbiting scroll 26 to induce rotation of the orbiting scroll 26. At this time, contact between the pins 30 and the inner circumferential surfaces of the respective ring members 29 prevents the orbiting scroll 26 from rotating and only allows orbital motion of the orbiting scroll 26. The orbiting scroll 26 performs orbital motion with the orbiting volute wall 26*b* being in contact with the fixed volute wall 25*b*. As the orbiting scroll 26 performs orbital motion, the volume of each compression chamber 27 decreases, so that the refrigerant is compressed in the compression chamber 27. The orbiting scroll 26 orbits on the radially inner side of the outer peripheral wall 25*c* along with the rotation of the rotary shaft 15.

Bushing Balancer

The bushing 42 includes a bushing balancer 50. The bushing balancer 50 projects from the cylindrical portion 43 and outward in the radial direction of the cylindrical portion 43. The bushing balancer 50 projects from a part of the outer circumferential surface of the portion of the cylindrical portion 43 projecting from the boss 28. The bushing balancer 50 is provided integrally with the cylindrical portion 43. The bushing balancer 50 is formed integrally with the cylindrical portion 43. The bushing balancer 50 is accommodated in the peripheral wall 18 of the shaft support housing 13.

Figure 2:
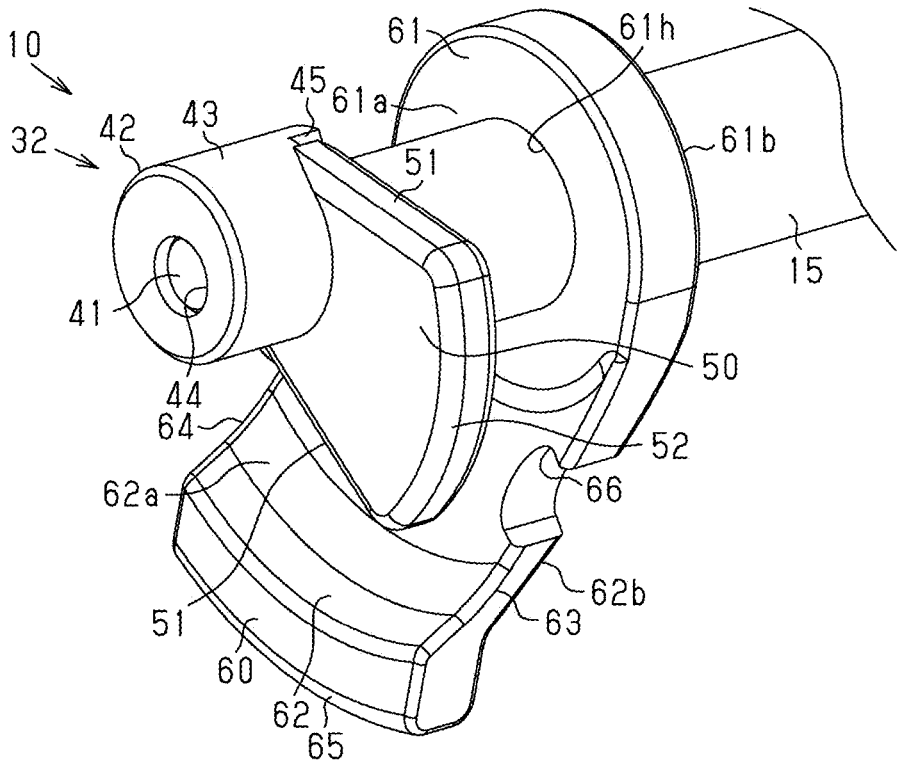
FIG. 2 is a perspective view of a portion of the scroll compressor shown in FIG. 1.
Figure 3:
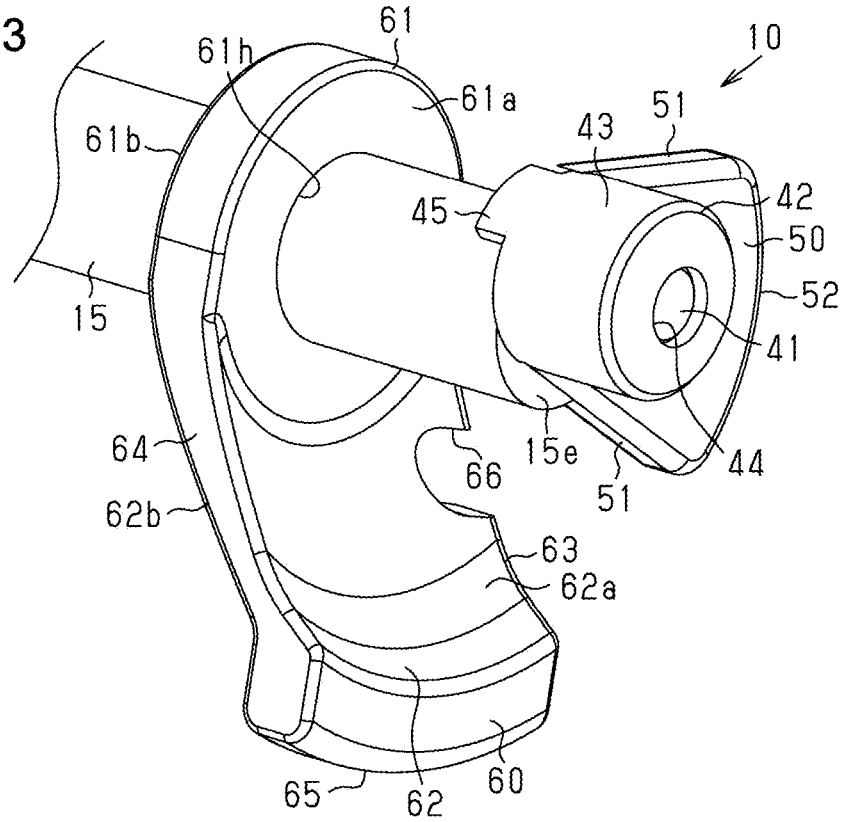
FIG. 3 is a perspective view of a portion of the scroll compressor shown in FIG. 1.

As shown in FIGS. 2 and 3, the bushing balancer 50 has the shape of a plate. The bushing balancer 50 has an arcuate shape when viewed in the axial direction of the rotary shaft 15. The bushing balancer 50 has two extending edges 51 and a connecting edge 52. The two extending edges 51 extend radially outward from the outer circumferential surface of the cylindrical portion 43. The two extending edges 51 are straight and separate from each other as they extend outward from the outer circumferential surface of the cylindrical portion 43. The connecting edge 52 connects radially outer ends of the two extending edges 51 to each other. The connecting edge 52 extends in an arcuate shape along the outer circumferential surface of the cylindrical portion 43.

Figure 4:
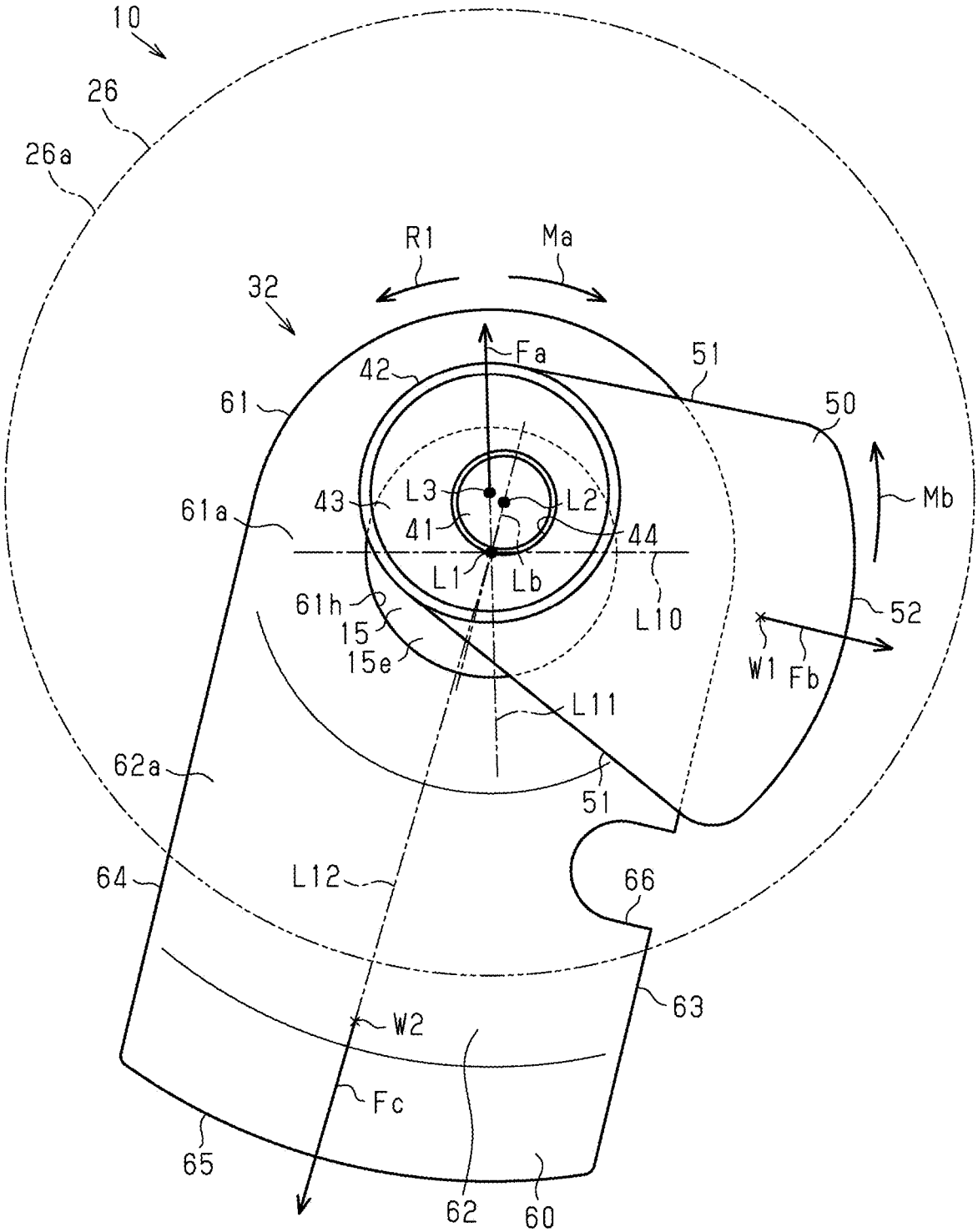
FIG. 4 is a front view of a portion of the scroll compressor shown in FIG. 1.

As shown in FIG. 4, the axis L2 of the eccentric shaft 41 is disposed at a position offset from a first straight line L11 that contains the axis L3 of the cylindrical portion 43 and the axis L1 of the rotary shaft 15, when viewed in the axial direction of the rotary shaft 15. The insertion hole 44 is formed in the cylindrical portion 43 such that, when viewed in the axial direction of the rotary shaft 15, the axis of the insertion hole 44 is disposed on the trailing side of the first straight line L11 in a rotation direction R1 of the rotary shaft 15, and at a position closer to the axis L1 of the rotary shaft 15 than the axis L3 of the cylindrical portion 43 is. Therefore, when viewed in the axial direction of the rotary shaft 15, the axis L2 of the eccentric shaft 41 is disposed on the trailing side of the first straight line L11 in the rotation direction R1 of the rotary shaft 15, and at a position closer to the axis L1 of the rotary shaft 15 than the axis L3 of the cylindrical portion 43 is.

The axis L3 of the cylindrical portion 43 agrees with the center of the orbiting base plate 26*a* of the orbiting scroll 26, when viewed in the axial direction of the rotary shaft 15. The center of the orbiting base plate 26*a* of the orbiting scroll 26 agrees with the center of gravity of the orbiting scroll 26, when viewed in the axial direction of the rotary shaft 15. A center of gravity W1 of the bushing balancer 50 is located on the same side of the first straight line L11 as the axis L2 of the eccentric shaft 41, when viewed in the axial direction of the rotary shaft 15. The center of gravity W1 of the bushing balancer 50 is located on the opposite side of the axis L2 of the eccentric shaft 41 from the center of gravity of the orbiting scroll 26, when viewed in the axial direction of the rotary shaft 15.

A centrifugal force Fa acts on the orbiting scroll 26 as the orbiting scroll 26 performs orbital motion. The vector of the centrifugal force Fa acting on the orbiting scroll 26 is located on an extension line of the first straight line L11. When the centrifugal force Fa acts on the orbiting scroll 26, a moment Ma about the eccentric shaft 41 is generated in the orbiting scroll 26. Further, a centrifugal force Fb acts on the bushing balancer 50 due to rotation of the rotary shaft 15. The vector of the centrifugal force Fb acting on the bushing balancer 50 is located on an extension line of a straight line containing the axis L1 of the rotary shaft 15 and the center of gravity W1 of the bushing balancer 50. When the centrifugal force Fb acts on the bushing balancer 50, a moment Mb around the eccentric shaft 41 is generated in the bushing balancer 50.

As described above, when viewed in the axial direction of the rotary shaft 15, the axis L2 of the eccentric shaft 41 is disposed on the trailing side of the first straight line L11 in the rotation direction R1 of the rotary shaft 15, and at a position closer to the axis L1 of the rotary shaft 15 than the axis L3 of the cylindrical portion 43 is. Therefore, the direction of the moment Ma about the eccentric shaft 41 in the orbiting scroll 26 is opposite to the rotation direction R1 of the rotary shaft 15, and the direction of the moment Mb about the eccentric shaft 41 in the bushing balancer 50 is the same as the rotation direction R1 of the rotary shaft 15. Therefore, the direction of the moment Ma about the eccentric shaft 41 in the orbiting scroll 26 is opposite to the direction of the moment Mb about the eccentric shaft 41 in the bushing balancer 50.

Specifically, when viewed in the axial direction of the rotary shaft 15, the center of gravity W1 of the bushing balancer 50 is located on the opposite side of a straight line Lb, connecting the axis L1 of the rotary shaft 15 and the axis L2 of the eccentric shaft 41, from the center of gravity of the orbiting scroll 26. Accordingly, the direction of the moment Ma about the eccentric shaft 41 generated by the centrifugal force Fa acting on the orbiting scroll 26 is opposite to the direction of the moment Mb around the eccentric shaft 41 generated by the centrifugal force Fb acting on the bushing balancer 50. As described above, the direction of the moment Mb about the eccentric shaft 41, which is generated by the centrifugal force Fb acting on the bushing balancer 50 due to rotation of the rotary shaft 15, is opposite to the direction of the moment Ma about the eccentric shaft 41, which is generated by the centrifugal force Fa acting on the orbiting scroll 26 due to orbital motion of the orbiting scroll 26. Thus, the moment Ma about the eccentric shaft 41 in the orbiting scroll 26 is counteracted by the moment Mb about the eccentric shaft 41 inf the bushing balancer 50.

Shaft Balancer

As shown in FIG. 1, the scroll compressor 10 includes a shaft balancer 60. The shaft balancer 60 projects from the rotary shaft 15 and outward in the radial direction of the rotary shaft 15. The shaft balancer 60 projects from a portion of the outer circumferential surface of the rotary shaft 15 between the rotor core 24*a* and the shaft support housing 13. The shaft balancer 60 is disposed between the motor 22 and the shaft support housing 13 in the motor chamber 20. The shaft balancer 60 rotates integrally with the rotary shaft 15. The weight of the shaft balancer 60 is greater than the weight of the bushing balancer 50.

As shown in FIGS. 2 and 3, the shaft balancer 60 includes a mounting portion 61 and a weight portion 62. The mounting portion 61 is cylindrical. The mounting portion 61 has a first end face 61*a* and a second end face 61*b*. The first end face 61*a* is an end face located at one end of the mounting portion 61 in the axial direction. The first end face 61*a* has a flat surface. The second end face 61*b* is an end face located at the other end of the mounting portion 61 in the axial direction. The second end face 61*b* is a flat surface.

The mounting portion 61 includes a press-fit hole 61*h*. The press-fit hole 61*h* extends through the mounting portion 61 in the axial direction of the mounting portion 61. A first end of the press-fit hole 61*h* is open in the first end face 61*a* of the mounting portion 61. A second end of the press-fit hole 61*h* opens in the second end face 61*b* of the mounting portion 61. The rotary shaft 15 is press-fitted into the press-fit hole 61*h*. The rotary shaft 15 extends through the press-fit hole 61*h*. The shaft balancer 60 is fixed to the rotary shaft 15 by press-fitting the rotary shaft 15 into the press-fit hole 61*h*.

The weight portion 62 has the shape of a plate. The weight portion 62 projects from the outer circumferential surface of the mounting portion 61 and outward in the radial direction of the mounting portion 61. The weight portion 62 has the shape of an elongated plate when viewed in the axial direction of the rotary shaft 15. The weight portion 62 has a first side edge 63, a second side edge 64, and a connecting edge 65. The first side edge 63 and the second side edge 64 extend radially outward from the outer circumferential surface of the mounting portion 61. The first side edge 63 and the second side edge 64 extend parallel to each other from the outer circumferential surface of the mounting portion 61. The connecting edge 65 connects the radially outer end of the first side edge 63 and the radially outer end of the second side edge 64 to each other. The connecting edge 65 extends in an arcuate shape so as to bulge in a direction away from the mounting portion 61.

The weight portion 62 has a first surface 62*a* and a second surface 62*b*. The first surface 62*a* and the second surface 62*b* face away from each other in the thickness direction of the weight portion 62. The first surface 62*a* is continuous with the first end face 61*a* of the mounting portion 61. The second surface 62*b* is continuous with the second end face 61*b* of the mounting portion 61. The first surface 62*a* extends from the first end face 61*a* of the mounting portion 61 and outward in the radial direction of the rotary shaft 15. The first surface 62*a* extends obliquely such that, as the first surface 62*a* extends radially outward from the first end face 61*a* of the mounting portion 61, the first surface 62*a* approaches the distal end face 15*e* of the rotary shaft 15 in the axial direction of the rotary shaft 15. The second surface 62*b* extends along the first surface 62*a*.

As shown in FIG. 4, the weight portion 62 is located on the opposite side of the axis L1 of the rotary shaft 15 from the eccentric shaft 41 when viewed in the axial direction of the rotary shaft 15. The center of gravity W2 of the shaft balancer 60 is located on the opposite side of the axis L1 of the rotary shaft 15 from the eccentric shaft 41 when viewed in the axial direction of the rotary shaft 15. When viewed in the axial direction of the rotary shaft 15, the center of gravity W2 of the shaft balance 60 is located on the opposite side of a straight line L10, which contains the axis L1 of the rotary shaft 15 and is orthogonal to the first straight line L11, from the axis L3 of the cylindrical portion 43. Therefore, the center of gravity W2 of the shaft balance 60 is located on the opposite side of the axis L1 of the rotary shaft 15 from the center of gravity of the orbiting scroll 26.

When viewed in the axial direction of the rotary shaft 15, the first side edge 63 of the weight portion 62 is located on the same side of a second straight line L12, which contains the center of gravity W2 of the shaft balancer 60 and the axis L1 of the rotary shaft 15, as the center of gravity W1 of the bushing balancer 50. When viewed in the axial direction of the rotary shaft 15, the shaft balancer 60 includes a first section, which is located on the same side of the second straight line L12 as the center of gravity W1 of the bushing balancer 50, and a second section, which is located on the opposite side of the second straight line L12 from the center of gravity W1 of the bushing balancer 50. The first side edge 63 of the weight portion 62 is a side edge of the first section of the shaft balancer 60.

The centrifugal force Fa, which acts on the orbiting scroll 26 due to orbital motion of the orbiting scroll 26, is directed away from the weight portion 62. A centrifugal force Fc acts on the shaft balancer 60 as the orbiting scroll 26 orbits. The direction of the centrifugal force Fc acting on the shaft balancer 60 is opposite to the direction of the centrifugal force Fa acting on the orbiting scroll 26. Thus, when the orbiting scroll 26 performs orbital motion, the centrifugal force Fa acting on the orbiting scroll 26 is counteracted by the centrifugal force Fc acting on the shaft balancer 60. Since the centrifugal force Fc acting on the shaft balancer 60 with the centrifugal force Fa acting on the orbiting scroll 26 are balanced, vibration of the rotary shaft 15 is suppressed.

Follower Crank Mechanism

The axis L3 of the cylindrical portion 43 of the bushing 42 is located outward of the axis L1 of the rotary shaft 15 in the radial direction of the rotary shaft 15. Since the center of the orbiting base plate 26*a* agrees with the axis L3 of the cylindrical portion 43, the distance between the axis L3 of the cylindrical portion 43 and the axis L1 of the rotary shaft 15 is equal to the orbital radius of the orbiting scroll 26.

When the bushing 42 swings about the eccentric shaft 41, the distance between the axis L3 of the cylindrical portion 43 and the axis L1 of the rotary shaft 15 changes, so that the orbital radius of the orbiting scroll 26 changes. As described above, the eccentric shaft 41, the bushing 42, and the bearing 46 form a so-called follower crank mechanism 32 that changes the orbital radius of the orbiting scroll 26. Such a follower crank mechanism 32 is already known.

Operation of the Follower Crank Mechanism

Since the fixed scroll 25 and the orbiting scroll 26 have minute machining errors and assembly errors, a clearance is provided in advance between the fixed volute wall 25*b* and the orbiting volute wall 26*b*.

When the rotary shaft 15 rotates in the forward direction, the bushing 42 swings about the eccentric shaft 41 due to the compression load acting on the orbiting scroll 26. When the bushing 42 swings about the eccentric shaft 41, the distance between the axis L3 of the cylindrical portion 43 and the axis L1 of the rotary shaft 15 increases, so that the orbital radius of the orbiting scroll 26 increases. When the orbiting volute wall 26*b* comes into contact with the fixed volute wall 25*b*, the swinging motion of the bushing 42 about the eccentric shaft 41 is restricted. As a result, the orbital radius of the orbiting scroll 26 is fixed.

Further, since the rotation of the rotary shaft 15 is transmitted to the orbiting scroll 26 via the eccentric shaft 41, the bushing 42, and the bearing 46, the orbiting scroll 26 rotates in the forward direction. When the orbiting volute wall 26*b* comes into contact with the fixed volute wall 25*b*, each pin 30 comes into contact with the corresponding ring member 29. This prevents the orbiting scroll 26 from rotating, and only allows orbital motion of the orbiting scroll 26 in the forward direction. The orbiting scroll 26 performs orbital motion in the forward direction with the orbiting volute wall 26*b* being in contact with the fixed volute wall 25*b*. Accordingly, leakage of refrigerant from the compression chambers 27 is suppressed, while the volume of each compression chamber 27 is reduced to compress the refrigerant.

When the orbiting scroll 26 is assembled with the fixed scroll 25, the bushing 42 is swung about the eccentric shaft 41 in a direction opposite to the direction in which the rotary shaft 15 rotates in the forward direction. As a result, the distance between the axis L3 of the cylindrical portion 43 and the axis L1 of the rotary shaft 15 decreases, so that the orbital radius of the orbiting scroll 26 decreases. Thus, the orbiting volute wall 26*b* is disposed with respect to the fixed volute wall 25*b* at a position where the orbiting volute wall 26*b* does not contact the fixed volute wall 25*b*. Accordingly, the orbiting scroll 26 can be readily assembled with the fixed scroll 25.

When the bushing 42 swings about the eccentric shaft 41 in a direction opposite to the direction in which the rotary shaft 15 rotates in the forward direction, the swinging motion of the bushing 42 is restricted by the swing restricting portion 45 before the distance between the axis L3 of the cylindrical portion 43 and the axis L1 of the rotary shaft 15 increases. When the bushing 42 swings about the eccentric shaft 41 in a direction opposite to the direction in which the rotary shaft 15 rotates in the forward direction, the swing restricting portion 45 restricts the swinging motion of the bushing 42 when the distance between the axis L3 of the cylindrical portion 43 and the axis L1 of the rotary shaft 15 becomes the shortest distance.

Cutout

A cutout 66 is formed in the shaft balancer 60. The cutout 66 is formed in the first side edge 63 of the weight portion 62. Accordingly, the cutout 66 is formed in the side edge of the first section of the shaft balancer 60. The cutout 66 is formed by arcuately cutting away a portion of the first side edge 63 toward the second side edge 64. In this manner, the first section of the shaft balancer 60 is lower stiffness than the second section of the shaft balancer 60.

Operation of the First Embodiment

Operation of the first embodiment will now be described.

The moment Ma about the eccentric shaft 41 in the orbiting scroll 26 is counteracted by the moment Mb about the eccentric shaft 41 inf the bushing balancer 50. Consequently, even when the centrifugal force Fa acts on the orbiting scroll 26 due to the rotation of the rotary shaft 15 and the orbital motion of the orbiting scroll 26, the orbiting volute wall 26*b* is prevented from being excessively pressed against the fixed volute wall 25*b*. Furthermore, the centrifugal force Fa acting on the orbiting scroll 26 is counteracted by the centrifugal force Fc acting on the shaft balancer 60. Therefore, even if the bushing 42 and the bushing balancer 50 swing simultaneously, rotational imbalance of the rotary shaft 15 is suppressed, thereby reducing vibration of the rotary shaft 15.

In the scroll compressor 10, the rotation speed of the rotary shaft 15 changes between a low rotation speed range and a high rotation speed range. When the rotation speed changes, the swing amount of the bushing balancer 50 changes due to the influence of the centrifugal force Fb acting on the bushing balancer 50. For example, the scroll compressor 10 is designed such that the moment Mb generated by the bushing balancer 50 and the moment Ma generated by the orbiting scroll 26 are balanced when the rotary shaft 15 rotates in a medium rotation speed range. When the rotary shaft 15 rotates in a high rotation speed range, the centrifugal force Fb acting on the bushing balancer 50 increases, and the swing amount of the bushing balancer 50 increases. The bushing balancer 50 swings in the direction of the moment Mb around the eccentric shaft 41. The direction of the moment Mb generated by the bushing balancer 50 is away from the center of gravity W2 of the shaft balancer 60 when viewed in the axial direction of the rotary shaft 15. Therefore, when the rotary shaft 15 rotates in the high rotation speed region, the position of the center of gravity W1 of the bushing balancer 50 shifts in a direction away from the center of gravity W2 of the shaft balancer 60 as viewed in the axial direction of the rotary shaft 15.

When the centrifugal force Fc acts on the shaft balancer 60, the shaft balancer 60 is deformed from the first section toward the second section as viewed in the axial direction of the rotary shaft 15 due to the presence of the cutout 66. Thus, when viewed in the axial direction of the rotary shaft 15, the position of the center of gravity W2 of the shaft balancer 60 moves in a direction away from the center of gravity W1 of the bushing balancer 50. Consequently, the position of the center of gravity W2 of the shaft balancer 60 moves in a direction opposite to the direction in which the position of the center of gravity W1 of the bushing balancer 50 shifts. This configuration prevents an imbalance from occurring between the moment Mb generated by the bushing balancer 50 and the moment Ma generated by the orbiting scroll 26.

Advantages of the First Embodiment

The first embodiment has the following advantages.

(1-1) For example, when the rotary shaft 15 rotates in a high rotation speed range, the centrifugal force Fb acting on the bushing balancer 50 increases, and the swing amount of the bushing balancer 50 increases. The bushing balancer 50 swings in the direction of the moment Mb around the eccentric shaft 41. The direction of the moment Mb around the eccentric shaft 41 generated by the centrifugal force Fb acting on the bushing balancer 50 is a direction away from the center of gravity W2 of the shaft balancer 60 as viewed in the axial direction of the rotary shaft 15. Therefore, when the rotary shaft 15 rotates in the high rotation speed region, the position of the center of gravity W1 of the bushing balancer 50 shifts in a direction away from the center of gravity W2 of the shaft balancer 60 as viewed in the axial direction of the rotary shaft 15.

The first section of the shaft balancer 60 is lower stiffness than the second section of the shaft balancer 60. Therefore, when the centrifugal force Fc acts on the shaft balancer 60, the shaft balancer 60 is deformed from the first section toward the second section. Thus, when viewed in the axial direction of the rotary shaft 15, the position of the center of gravity W2 of the shaft balancer 60 moves in a direction away from the center of gravity W1 of the bushing balancer 50. Consequently, the position of the center of gravity W2 of the shaft balancer 60 moves in a direction opposite to the direction in which the position of the center of gravity W1 of the bushing balancer 50 shifts. This configuration prevents an imbalance from occurring between the moment Mb generated by the bushing balancer 50 and the moment Ma generated by the orbiting scroll 26. Accordingly, the vibration of the rotary shaft 15 is suppressed.

(1-2) The cutout 66 is formed in the side edge of the first section of the shaft balancer 60. This configuration allows the stiffness of the first section of the shaft balancer 60 to be readily reduced compared to the stiffness of the second section of the shaft balancer 60.

Second Embodiment

A scroll compressor 10 according to a second embodiment will now be described with reference to FIG. 5. In the embodiment described below, the same reference numerals are given to those components that are the same as the corresponding components of the first embodiment, which has already been described, and explanations are omitted or simplified.

Figure 5:
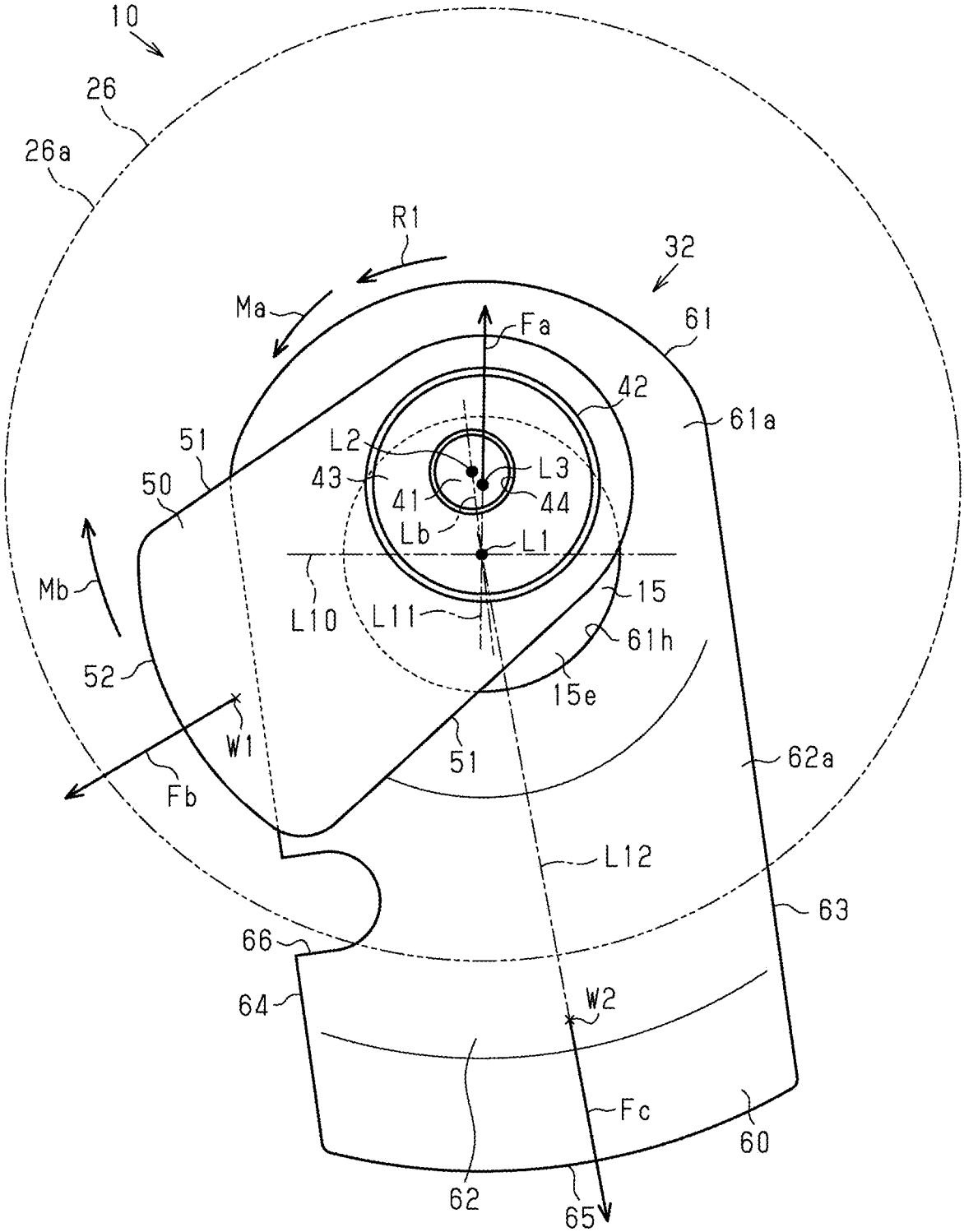
FIG. 5 is a front view of a portion of a scroll compressor according to a second embodiment.

As shown in FIG. 5, the insertion hole 44 is formed in the cylindrical portion 43 such that, when viewed in the axial direction of the rotary shaft 15, the axis of the insertion hole 44 is disposed on the leading side of the first straight line L11 in the rotation direction R1 of the rotary shaft 15, and at a position farther from the axis L1 of the rotary shaft 15 than the axis L3 of the cylindrical portion 43 is. Therefore, when viewed in the axial direction of the rotary shaft 15, the axis L2 of the eccentric shaft 41 is disposed on the leading side of the first straight line L11 in the rotation direction R1 of the rotary shaft 15, and at a position farther from the axis L1 of the rotary shaft 15 than the axis L3 of the cylindrical portion 43 is.

When the centrifugal force Fa acts on the orbiting scroll 26, a moment Ma about the eccentric shaft 41 is generated in the orbiting scroll 26. Also, when the centrifugal force Fb acts on the bushing balancer 50, a moment Mb around the eccentric shaft 41 is generated in the bushing balancer 50. When viewed in the axial direction of the rotary shaft 15, the axis L2 of the eccentric shaft 41 is disposed on the leading side of the first straight line L11 in the rotation direction R1 of the rotary shaft 15, and at a position farther from the axis L1 of the rotary shaft 15 than the axis L3 of the cylindrical portion 43 is. Therefore, the direction of the moment Ma about the eccentric shaft 41 in the orbiting scroll 26 is the same as the rotation direction R1 of the rotary shaft 15, and the direction of the moment Mb about the eccentric shaft 41 in the bushing balancer 50 is opposite to the rotation direction R1 of the rotary shaft 15. Therefore, the direction of the moment Ma about the eccentric shaft 41 in the orbiting scroll 26 is opposite to the direction of the moment Mb about the eccentric shaft 41 in the bushing balancer 50.

Specifically, when viewed in the axial direction of the rotary shaft 15, the center of gravity W1 of the bushing balancer 50 is located on the opposite side of a straight line Lb, connecting the axis L1 of the rotary shaft 15 and the axis L2 of the eccentric shaft 41, from the center of gravity of the orbiting scroll 26. Accordingly, the direction of the moment Ma about the eccentric shaft 41 generated by the centrifugal force Fa acting on the orbiting scroll 26 is opposite to the direction of the moment Mb around the eccentric shaft 41 generated by the centrifugal force Fb acting on the bushing balancer 50. As described above, the direction of the moment Mb about the eccentric shaft 41, which is generated by the centrifugal force Fb acting on the bushing balancer 50 due to rotation of the rotary shaft 15, is opposite to the direction of the moment Ma about the eccentric shaft 41, which is generated by the centrifugal force Fa acting on the orbiting scroll 26 due to orbital motion of the orbiting scroll 26. Thus, the moment Ma about the eccentric shaft 41 in the orbiting scroll 26 is counteracted by the moment Mb about the eccentric shaft 41 inf the bushing balancer 50.

When viewed in the axial direction of the rotary shaft 15, the second side edge 64 of the weight portion 62 is located on the same side of the second straight line L12, which contains the center of gravity W2 of the shaft balancer 60 and the axis L1 of the rotary shaft 15, as the center of gravity W1 of the bushing balancer 50. Accordingly, the second side edge 64 of the weight portion 62 is a side edge of the first section of the shaft balancer 60.

A cutout 66 is formed in the shaft balancer 60. The cutout 66 is formed in the second side edge 64 of the weight portion 62. Accordingly, the cutout 66 is formed in the side edge of the first section of the shaft balancer 60. The cutout 66 is formed by arcuately cutting away a portion of the second side edge 64 toward the first side edge 63. In this manner, the first section of the shaft balancer 60 is lower stiffness than the second section of the shaft balancer 60. Thus, the second embodiment has operation and advantages similar to the first embodiment.

Advantages of the Second Embodiment

The second embodiment has the following advantages.

(2-1) When viewed in the axial direction of the rotary shaft 15, the axis L2 of the eccentric shaft 41 is disposed on the leading side of the first straight line L11 in the rotation direction R1 of the rotary shaft 15, and at a position farther from the axis L1 of the rotary shaft 15 than the axis L3 of the cylindrical portion 43 is. Even with this configuration, it is possible to suppress the vibration of the rotary shaft 15 when the rotary shaft 15 rotates in a high rotation speed range.

Modifications

The above-described embodiments may be modified as described below. The above-described embodiments and the following modifications can be combined as long as the combined modifications remain technically consistent with each other.

Figure 6:
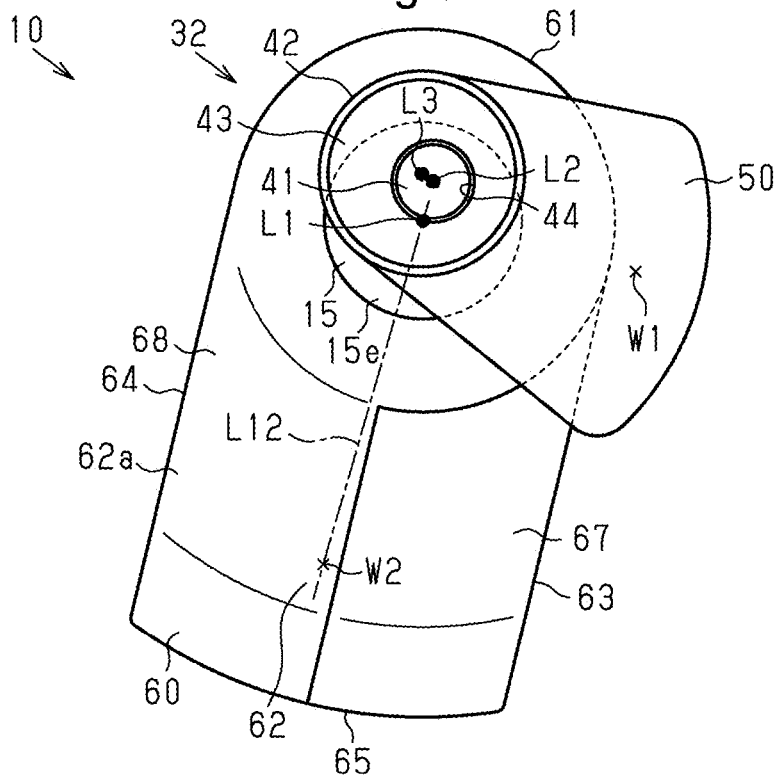
FIG. 6 is a front view of a portion of a scroll compressor according to a first modification.
Figure 7:
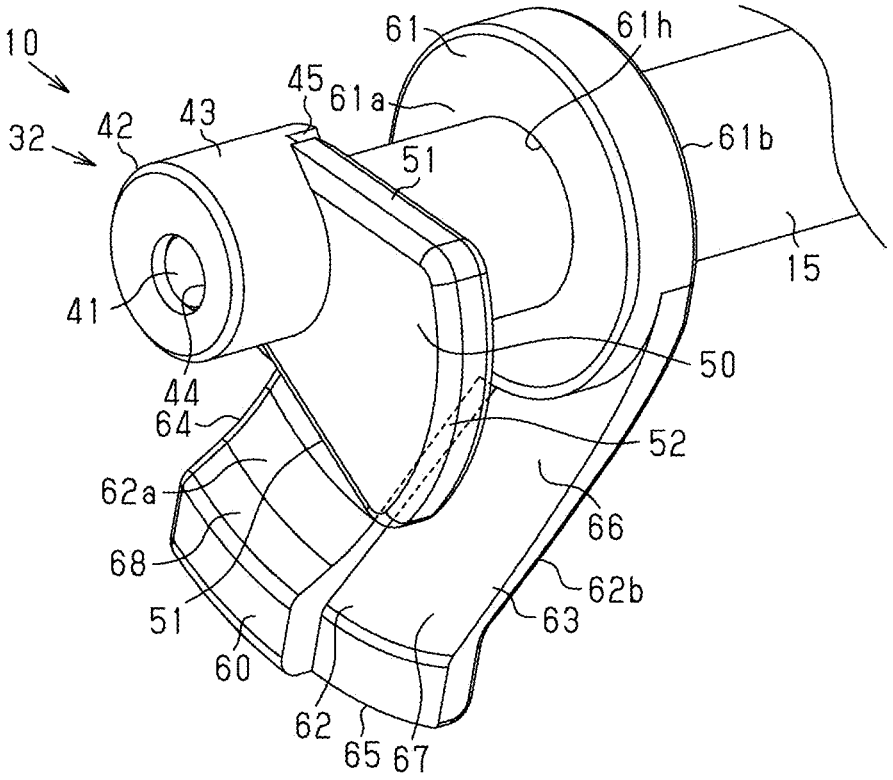
FIG. 7 is a perspective view of a portion of a scroll compressor according to a second modification.

As shown in FIGS. 6 and 7, the weight portion 62 may include a thin portion 67 and a thick portion 68. The thin portion 67 is provided in a section of the weight portion 62 that is located on the same side of the second straight line L12 as the center of gravity W1 of the bushing balancer 50, when viewed in the axial direction of the rotary shaft 15. Accordingly, the thin portion 67 is provided in the first section of the shaft balancer 60. When viewed in the axial direction of the rotary shaft 15, a section of the weight portion 62 located on the opposite side of the second straight line L12 from the center of gravity W1 of the bushing balancer 50 is the thick portion 68, which is thicker than the thin portion 67. The first surface 62*a* of the weight portion 62 forms a stepped boundary between the thin portion 67 and the thick portion 68. This configuration allows the stiffness of the first section of the shaft balancer 60 to be reduced compared to the stiffness of the second section of the shaft balancer 60. Additionally, the shaft balancer 60, which includes the thick portion 68 and the thin portion 67, is easy to manufacture.

Figure 8:
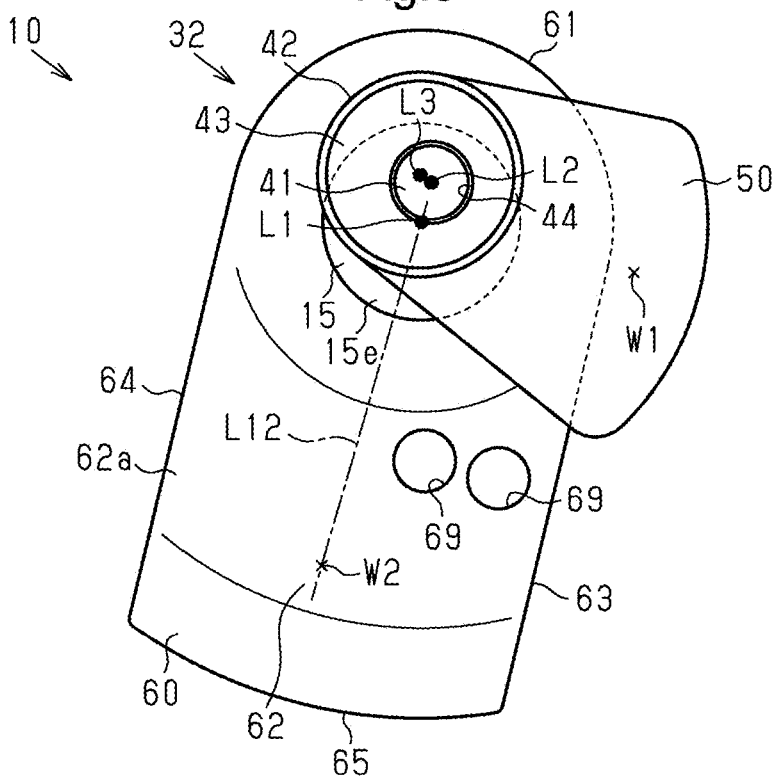
FIG. 8 is a front view of a portion of a scroll compressor according to a third modification.

As shown in FIG. 8, the shaft balancer 60 may include one or more through-holes 69 in the first section that extend through the shaft balancer 60 in the axial direction of the rotary shaft 15. Two through-holes 69 are formed in the weight portion 62. Each of the through-holes 69 extends through the weight portion 62 in the thickness direction of the weight portion 62. The number of the through-holes 69 formed in the shaft balancer 60 is not particularly limited. This configuration allows the stiffness of the first section of the shaft balancer 60 to be reduced compared to the stiffness of the second section of the shaft balancer 60. The through-holes 69 can be easily formed in the shaft balancer 60.

Figure 9:
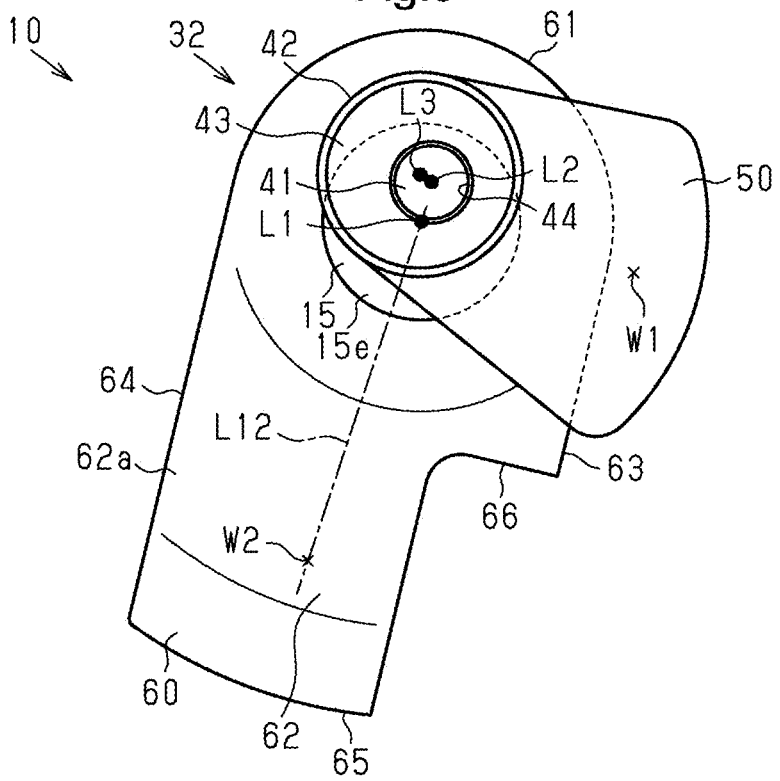
FIG. 9 is a front view of a portion of a scroll compressor according to a fourth modification.

As shown in FIG. 9, the shaft balancer 60 may include, for example, a cutout 66 that is formed by cutting away a section from the first side edge 63 to the connecting edge 65. In short, the shape of the cutout 66 formed in the first section of the shaft balancer 60 is not particularly limited.

Figure 10:
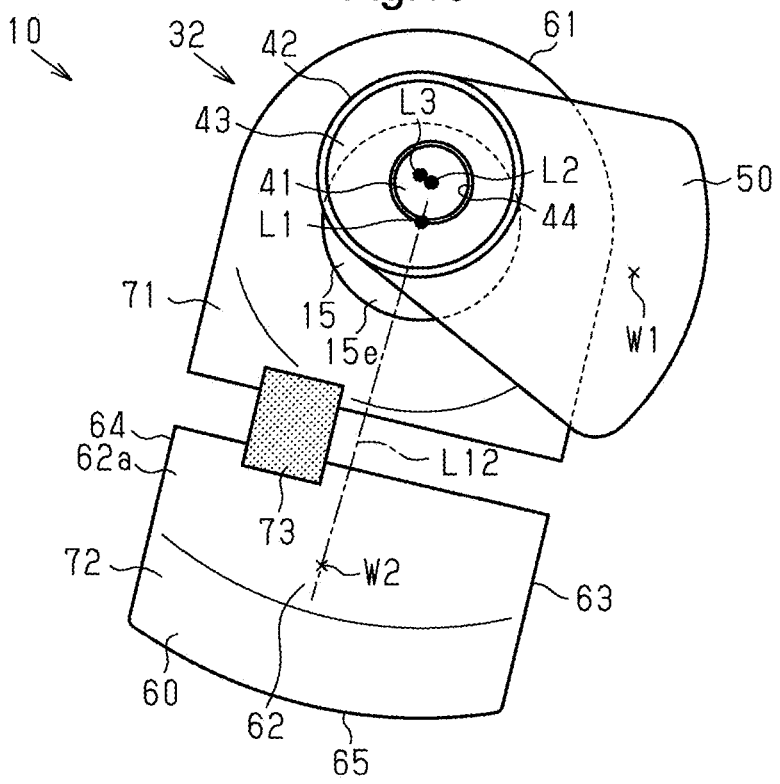
FIG. 10 is a front view of a portion of a scroll compressor according to a fifth modification.

As shown in FIG. 10, the weight portion 62 may include a first segment 71 and a second segment 72. When viewed in the axial direction of the rotary shaft 15, the first segment 71 and the second segment 72 are joined to each other by a joint portion 73 on the opposite side of the second straight line L12 from the center of gravity W1 of the bushing balancer 50. The joint portion 73 may be, for example, a joint portion in which the first segment 71 and the second segment 72 are joined to each other with different materials, or a welded portion where the first segment 71 and the second segment 72 are joined to each other by welding. With this configuration, the stiffness of the first section of the shaft balancer 60 may be lower than the stiffness of the second section of the shaft balancer 60.

Figure 11:
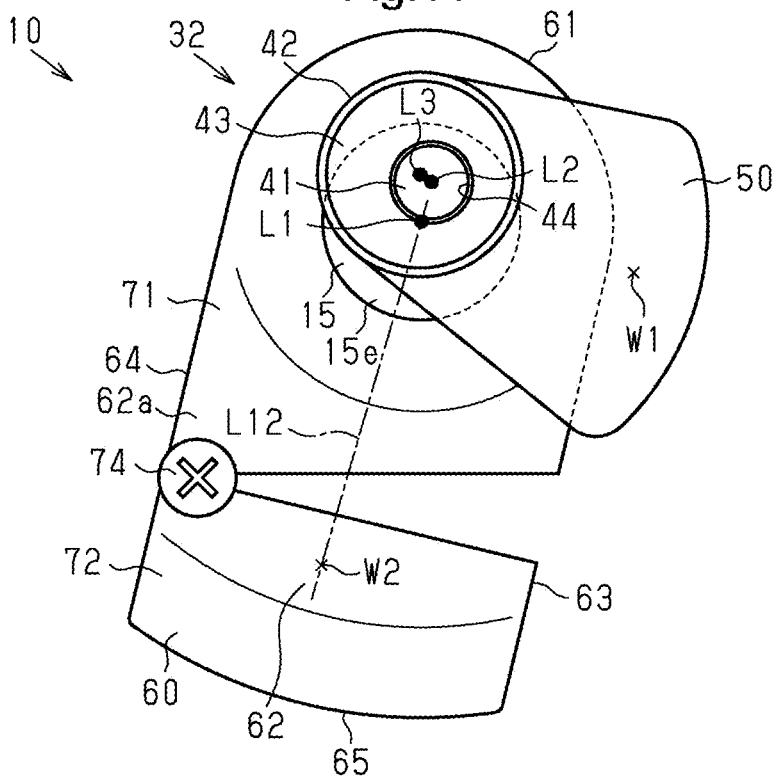
FIG. 11 is a front view of a portion of a scroll compressor according to a sixth modification.

As shown in FIG. 11, the weight portion 62 may include a first segment 71 and a second segment 72. When viewed in the axial direction of the rotary shaft 15, the first segment 71 and the second segment 72 are joined to each other by a bolt 74 on the opposite side of the second straight line L12 from the center of gravity W1 of the bushing balancer 50. With this configuration, the stiffness of the first section of the shaft balancer 60 may be lower than the stiffness of the second section of the shaft balancer 60.

In each of the above-described embodiments, the eccentric shaft 41 may be formed integrally with the rotary shaft 15.

In each of the above-described embodiments, the bearing 46 is not limited to a plain bearing, and may be, for example, a rolling-element bearing.

In each of the above-described embodiments, the scroll compressor 10 does not have to be driven by the motor 22 and may be driven by, for example, the engine of a vehicle.

In each of the above-described embodiments, the scroll compressor 10 is used in the vehicle air conditioner. However, the scroll compressor 10 may be used in other apparatuses. The scroll compressor 10 may be any compressor that compresses refrigerant, and the use of the scroll compressor 10 can be appropriately changed.

In each of the above-described embodiments, the compression target of the scroll compressor 10 is not limited to the refrigerant, and may be, for example, a fluid such as air.

Various changes in form and details may be made to the examples above without departing from the spirit and scope of the claims and their equivalents. The examples are for the sake of description only, and not for purposes of limitation. Descriptions of features in each example are to be considered as being applicable to similar features or aspects in other examples. Suitable results may be achieved if sequences are performed in a different order, and/or if components in a described system, architecture, device, or circuit are combined differently, and/or replaced or supplemented by other components or their equivalents. The scope of the disclosure is not defined by the detailed description, but by the claims and their equivalents. All variations within the scope of the claims and their equivalents are included in the disclosure.

What is claimed is:

1. A scroll compressor, comprising:

a rotary shaft;

an eccentric shaft projecting from a distal end of the rotary shaft and extending parallel to the rotary shaft at a position offset from an axis of the rotary shaft;

a fixed scroll that includes a fixed base plate and a fixed volute wall extending from the fixed base plate;

an orbiting scroll that includes an orbiting base plate and an orbiting volute wall, the orbiting base plate facing the fixed base plate, and the orbiting volute wall extending from the orbiting base plate toward the fixed base plate and meshing with the fixed volute wall;

a bushing that includes an insertion hole that receives the eccentric shaft, the bushing being configured to swing about the eccentric shaft; and a shaft balancer that projects from the rotary shaft and outward in a radial direction of the rotary shaft, the shaft balancer being configured to rotate integrally with the rotary shaft, wherein the bushing includes:

a cylindrical portion that includes the insertion hole and is inserted into the orbiting base plate so as to be rotatable with respect to the orbiting base plate; and a bushing balancer that projects from the cylindrical portion and outward in a radial direction of the cylindrical portion, when viewed in an axial direction of the rotary shaft, a center of gravity of the bushing balancer is located on a same side of a first straight line as an axis of the eccentric shaft, the first straight line containing an axis of the cylindrical portion and the axis of the rotary shaft, when viewed in the axial direction of the rotary shaft, a center of gravity of the shaft balancer is located on an opposite side of a straight line from the eccentric shaft, the straight line containing the axis of the rotary shaft and being orthogonal to the first straight line, when viewed in the axial direction of the rotary shaft, a direction of a moment about the eccentric shaft generated by a centrifugal force acting on the bushing balancer is a direction away from the center of gravity of the shaft balancer, the shaft balancer includes:

a first section that is located, when viewed in the axial direction of the rotary shaft, on a same side of a second straight line as the center of gravity of the bushing balancer, the second straight line containing the center of gravity of the shaft balancer and the axis of the rotary shaft; and a second section that is located on an opposite side of the second straight line from the center of gravity of the bushing balancer, and a stiffness of the first section is lower than a stiffness of the second section.

2. The scroll compressor according to claim 1, wherein a cutout is formed in a side edge of the first section of the shaft balancer.

3. The scroll compressor according to claim 1, wherein a thin portion is provided in the first section of the shaft balancer.

4. The scroll compressor according to claim 1, wherein the first section of the shaft balancer includes a through-hole extending through the first section in the axial direction.

* * * * *